United States Patent [19]

Bates et al.

[11] 4,421,572

[45] Dec. 20, 1983

[54] THERMOMECHANICAL TREATMENT OF ALLOYS

[75] Inventors: John F. Bates, Ogden, Utah; Howard R. Brager, Richland, Wash.; Michael M. Paxton, Gaithersburg, Md.

[73] Assignee: The United States of America as represented by the United States Department of Energy, Washington, D.C.

[21] Appl. No.: 359,549

[22] Filed: Mar. 18, 1982

[51] Int. Cl.[3] ..... C21D 8/00; C21D 8/10

[52] U.S. Cl. ..... 148/12 E; 148/12.3

[58] Field of Search ..... 148/12 E, 12.3, 12 EA; 75/128 A, 128 W

[56] References Cited

U.S. PATENT DOCUMENTS

| | | | |
|---|---|---|---|
| 2,278,495 | 4/1942 | Schaufus | 148/12 E |
| 2,562,854 | 7/1951 | Binder | 148/12 E |
| 3,347,715 | 10/1967 | Pfeil | 148/12 E |
| 3,573,109 | 3/1971 | Levy | 148/11.5 N |
| 3,684,589 | 8/1972 | Brickner | 148/12 EA |
| 3,694,271 | 9/1972 | Egnell | 148/12 E |
| 3,776,784 | 12/1973 | Rowe | 148/12 EA |

*Primary Examiner*—W. Stallard

*Attorney, Agent, or Firm*—John J. Prizzi

[57] ABSTRACT

An article of an alloy of AISI 316 stainless steel is reduced in size to predetermined dimensions by cold working in repeated steps. Before the last reduction step the article is annealed by heating within a temperature range, specifically between 1010° C. and 1038° C. for a time interval between 90 and 60 seconds depending on the actual temperature. By this treatment the swelling under neutron bombardment by epithermal neutrons is reduced while substantial recrystallization does not occur in actual use for a time interval of at least of the order of 5000 hours.

7 Claims, 9 Drawing Figures

THERMOMECHANICAL TREATMENT OF ALLOYS

BACKGROUND OF THE INVENTION

This invention relates to the alloy art and has particular relationship to the thermomechanical processing of alloys which are used in nuclear reactors. The alloys with which this invention concerns itself is AISI 316 stainless steel but, for the use involved here, the composition of the alloy is maintained within more restricted limits than is usually specified for AISI 316 alloy (Handbook of Physics and Chemistry, 43rd Edition, Pg. 1542). The specified composition of this alloy in weight percent is presented in the following Table I:

TABLE I

| | Specified Composition |
|---|---|
| Chromium | 17.00–18.00 |
| Nickel | 13.00–14.00 |
| Carbon | 0.040–0.060 |
| Molybdenum | 2.00–3.00 |
| Manganese | 1.50–2.00 |
| Nitrogen | 0.010 maximum |
| Aluminum | 0.050 maximum |
| Arsenic | 0.030 maximum |
| Boron | 0.0010 maximum |
| Cobalt | 0.050 maximum |
| Columbium | 0.050 maximum |
| Copper | 0.04 maximum |
| Phosphorous | 0.020 maximum |
| Silicon | 0.50–0.75 |
| Sulphur | 0.010 maximum |
| Tantalum | 0.020 maximum |
| Vanadium | 0.200 maximum |
| Iron | Balance |

This invention is based on investigation and studies carried out with alloys identified as CN-13 and CK 25. The chemical composition of five specimens of heat 81592 of CN-13 in weight percent is presented in the following Table II:

TABLE II

| | #1 | #2 | #3 | #4 | #5 |
|---|---|---|---|---|---|
| C | .055 | .055 | .054 | .054 | .053 |
| Mn | 1.67 | 1.63 | 1.66 | 1.69 | 1.67 |
| Si | .51 | .52 | .52 | .50 | .51 |
| P | .003 | .004 | .004 | .002 | .003 |
| S | .003 | .004 | .004 | .003 | .004 |
| Cr | 17.26 | 17.28 | 17.39 | 17.29 | 17.26 |
| Ni | 13.83 | 13.77 | 13.72 | 13.78 | 13.72 |
| Mo | 2.29 | 2.25 | 2.26 | 2.25 | 2.25 |
| Cu | <.01 | <.01 | <.01 | <.01 | <.01 |
| Co | .01 | .01 | .03 | .01 | .02 |
| V | .01 | .01 | .01 | .01 | .01 |
| Al | <.005 | <.005 | <.005 | <.005 | <.005 |
| N | .004 | .004 | .004 | .004 | .004 |
| Cb | <.01 | <.01 | <.01 | <.01 | <.01 |
| Ta | <.015 | <.015 | <.015 | <.015 | <.015 |
| As | <.005 | <.005 | <.005 | <.005 | <.005 |
| B | .0007 | .0005 | .0008 | .0005 | <.0005 |

The range of the compositions of Table II is presented in the following Table III:

TABLE III

| | |
|---|---|
| Chromium | 17.26–17.39 |
| Nickel | 13.72–13.83 |
| Carbon | 0.053–0.055 |
| Molybdenum | 2.25–2.29 |
| Manganese | 1.63–1.69 |
| Nitrogen | 0.004 |
| Aluminum | <0.005 |

TABLE III-continued

| | |
|---|---|
| Arsenic | <0.005 |
| Boron | 0.0007 |
| Cobalt | 0.01–0.03 |
| Columbium | <0.01 |
| Copper | <0.01 |
| Phosphorous | 0.002–0.004 |
| Silicon | 0.50–0.52 |
| Sulfur | 0.003–0.004 |
| Tantalum | <0.015 |
| Vanadium | 0.01 |
| Iron | Balance |

The chemical compositions of five specimens of heat 81615 of alloy CK-25 in weight percent is presented in the following Table IV:

TABLE IV

| | #1 | #2 | #3 | #4 | #5 |
|---|---|---|---|---|---|
| C | .056 | .057 | .056 | .056 | .056 |
| Mn | 1.70 | 1.69 | 1.66 | 1.68 | 1.68 |
| Si | .51 | .51 | .50 | .51 | .50 |
| P | .002 | .002 | .002 | .002 | .002 |
| S | .003 | .003 | .003 | .003 | .003 |
| Cr | 17.56 | 17.51 | 17.46 | 17.48 | 17.54 |
| Ni | 13.84 | 13.82 | 13.67 | 13.75 | 13.82 |
| Mo | 2.34 | 2.32 | 2.296 | 2.28 | 2.32 |
| Cu | <.01 | <.01 | <.01 | <.01 | <.01 |
| Co | .01 | .01 | .03 | .01 | .01 |
| V | <.01 | <.01 | <.01 | <.01 | <.01 |
| Al | .011 | .007 | .007 | .005 | .005 |
| N | .004 | .003 | .004 | .004 | .004 |
| B | .0005 | .0007 | .0005 | .0005 | .0005 |
| Cb | <.005 | <.005 | <.005 | <.005 | <.005 |
| Ta | <.01 | <.01 | <.01 | <.01 | <.01 |
| As | <.005 | <.005 | <.005 | <.005 | <.005 |

The range of the compositions of Table IV is presented in the following Table V:

TABLE V

| | |
|---|---|
| Chromium | 17.46–17.56 |
| Nickel | 13.67–13.82 |
| Carbon | 0.056–0.057 |
| Molybdenum | 2.28–2.34 |
| Manganese | 1.66–1.70 |
| Nitrogen | 0.003–0.004 |
| Aluminum | 0.005–0.011 |
| Arsenic | <0.005 |
| Boron | 0.0005–0.0007 |
| Cobalt | 0.01 |
| Columbium | <0.005 |
| Copper | <0.01 |
| Phosphorous | 0.002 |
| Silicon | 0.50–0.51 |
| Sulfur | 0.003 |
| Tantalum | <0.01 |
| Vanadium | <0.01 |
| Iron | Balance |

Investigation of swelling was conducted with CN-13. The investigation and studies which led to this invention were conducted with heat 81615 of alloy CK-25.

The 316 alloy is used for cladding for the fuel pins, for ducts and also for other parts, such as control rod and absorber cladding, of nuclear reactors in which the fission is produced by neutrons in the epithermal energy range. The energy E of such neutrons are usually measured in units greater than one-tenth million electron volts ($E>0.1$ MeV). Typically, epithermal neutrons produce fission in breeder reactors. In this application the parts and specimens which are investigated are referred to generally as articles.

Articles of 316 stainless steel, which are bombarded by neutrons in the epithermal range, swell. The effect of the neutron flux in producing the swelling is evaluated in terms of a function called the neutron fluence:

$$\text{Neutron Fluence} = \phi T$$

where $\phi$ is the neutron flux and T the time of exposure of the article to the flux. The magnitude of the swelling influences the range of reactor environment and designed exposures in the continued use of the article. Where excessive swelling occurs, the reactor must be shut down and the affected article replaced.

The nuclear reactor articles composed of 316 stainless steel are made from ingots which after adequate processing are pressed into billets. The billets are converted by reduction and rolling and other treatment into the desired shapes and the resulting parts are reduced in size by cold working in a number of reducing steps. The billets and the components to which the billets are converted are also referred to herein as articles. Typically, the selected dimension (cross-sectional area) of each article is reduced to a small fraction of its initial magnitude. The article is subjected to eight to ten reductions by cold working to achieve the final dimension. Prior to each size reduction each article is cleaned, examined visually, annealed, pointed (the dimensions of the article which is being reduced is made smaller than the reducing die at one end) and lubricated. It has been known that swelling resulting from irradiation by neutron flux is reduced significantly from the annealed article if the last step reduces the cross-sectional area by 20%. The article thus produced is sometimes referred to as 20% cold-worked AISI 316 stainless steel. In accordance with the teachings of the prior art the minimum annealing temperature during reduction and particularly during the last reducing step is in excess of 1038° C., typically about 1051° C. or higher. Notwithstanding that swelling is reduced if the reduction is 20% during the last step, undesirable swelling has still been experienced in articles treated in accordance with the prior art.

It is an object of this invention to further minimize the swelling of articles made of AISI 316 stainless steel subjected to neutron fluence.

SUMMARY OF THE INVENTION

This invention arises from the discovery that the magnitude of the swelling is an increasing function of the high temperature at which the alloy is maintained during annealing before it is cooled. This high temperature is herein referred to as the annealing temperature. The lower the annealing temperature, the less the swelling. To reduce swelling it is desirable that the annealing temperature be reduced.

The predominant thermodynamic phenomenon which occurs during the annealing of the articles is that the atoms of the metals of the alloy, as distinct from its compounds such as carbides, rearrange themselves. This rearrangement results in the removal of the irregularities in the annealed article which are produced by the previous cold working. Following the annealing, the article has the ductility which it had prior to the cold working. During the first anneal the irregularities produced during the prior treatment of the article are removed. During subsequent anneal the irregularities produced by the cold working are removed. The annealing before each reduction step is necessary to endow the article with the ductility necessary to reduce the article after the anneal. So that an annealing is effective in removing irregularities, it is necessary that the annealing temperature be maintained for an adequate time interval. The lower the temperature, the longer the time during which the temperature is maintained. In taking advantage of the above-described discovery, it is necessary that the lower annealing temperature be coordinated with the time during which the article is maintained at this temperature. Also, since the ultimate structure of the article is determined by the last reduction step, i.e., the 20% step, the annealing temperature before the last reduction step, is the most effective in determining the alloy's swelling resistance to irradiation. However, it appears reasonable that the objective of the invention may be achieved by annealing at the lower temperature at earlier reduction steps than the last step. In accordance with this invention, the annealing temperature during at least one step in the reduction process, and specifically immediately prior to the last reduction step, is maintained substantially lower than is prior-art practice.

Another aspect of this invention involves the recrystallization of the processed article when, following the last reduction, it is put into use. The recrystallization occurs at a predetermined time interval after the article is put into use. This interval is called herein the recrystallization time. Recrystallization, among its other effects, deprives the article of the strength properties with which it was endowed by the prior art processing. It has been found that, at any temperature at which the article may be maintained, the recrystallization time increases with the annealing temperature. The desirability of annealing at lower temperature to reduce swelling is counteracted by reduced recrystallization time at lower annealing temperatures. It is essential that the annealing temperature be selected so that when the article is in use, the recrystallization time, with the article subjected continuously to elevated temperature, shall be at least of the order of 5,000 hours. It has been found in arriving at this invention that in practice this object can be achieved. Typically, the upper limit of the temperature at which the article is used in a reactor is between about 1100° F. and 1200° F. or between about 593° C. and 649° C. It has been found that with the annealing temperature between about 1010° C. and 1038° C., the annealing time for use in reactors operating between 580° C. and 635° C. is of the order of 10,000 hours. It is emphasized that the nuclear reactors, in which the article treated in accordance with this invention are included, are on line only during limited intervals and even when on line are frequently not operated at the high temperatures. The crystallization time for continuous operation of 5000 hours is therefore adequate to avail a useful life for the articles.

In summary, in accordance with this invention the annealing temperature, prior to at least one reduction step and specifically prior to the last step, is set at a substantially lower magnitude than that taught by the prior art so as to effectively reduce swelling but at a magnitude such that the recrystallization time is of the order of 5000 hours or more. Further, the annealing temperature is coordinated with the annealing time so that the anneal of the article prior to the selected reduction step is effective. Specifically, the annealing temperature is set between 1010° C. and 1038° C. and the annealing time is set between 90 seconds and 60 seconds at a time interval 90-$\Delta T$, where $\Delta T$ is a time interval given by the equation:

$$\Delta T = \frac{30(t - 1010)}{28}$$

where t is the annealing temperature in centigrade degrees. It has also been found that during annealing the article should be heated to the annealing temperature between 1010° C. and 1038° C. at the rate of at least 540° C. per minute and should be cooled from this annealing temperature after the time at the annealing temperature elapses at the rate of at least 870° C. per minute.

BRIEF DESCRIPTION OF THE DRAWINGS

For a better understanding of this invention, both as to its organization and as to its method of operation, together with additional objects and advantages thereof, reference is made to the following description taken in connection with the accompanying drawings in which.

mens of tubing cut in half having a length of about 2.54 cm and an outer diameter of 0.584 cm (0.230 inch) and an inner diameter of 0.508 cm (0.200 inch). A large number of specimens were investigated.

Figure 1:
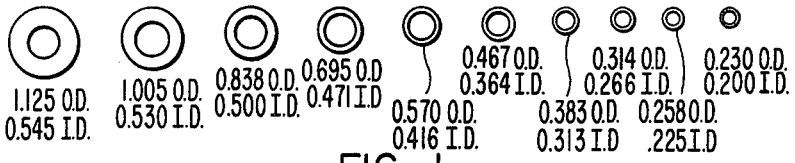
FIG. 1 is a diagram showing the steps in which an article processed in accordance with this invention is reduced.

The heat (81615) of the alloy which served for the investigation was melted as a vacuum induction melt followed by vacuum arc remelting using electrolytic grades of the principal components, nickel, chromium, iron and manganese; metallic silicon and molybdenum; and electrolytic carbon to compound the melt. A 35.5 cm electrode was poured, remelted as a 40.6 cm ingot, air-cooled, heated to 1204°-1260° C. for 6-10 hours and pressed to 25 cm square billets. The 25.4 cm square billets were re-cogged (reduced) to 12.7 cm, heated to 1204°-1260° C. and hot rolled to 3.8 cm diameter. The bars were then annealed at 1066° C., water-quenched, cold drawn to 3.5 cm diameter and centerless ground to size. Fabrication into tubing was accomplished by gun-drilling short sections of finished bar and using the 9-step reduction sequence shown in FIG. 1. The specimens were reduced to the final dimensions, in the steps typically as shown in FIG. 1. FIG. 1 applies particularly to the CK-25 alloy. Initially, the article reduced as shown in FIG. 1 had an O.D.=2.858 cm and an I.D. of 1,384 cm. The initial cross-sectional area was then $\pi(2.042-0.479)=1.563\pi$ cm$^2$. The final reduced article had an O.D.=0.584 cm and an I.D. of 0.508 cm. The final cross-sectional area was $\pi(0.3411-0.2581)=0.0207$ cm$^2$. The ratio of the final area to the initial area was 0.0207/1.563=0.013. The reduction was 98.7%. The O.D. of the article prior to the last reducing step was 0.655 cm. and the I.D. 0.572 cm. The cross-sectional area was then $\pi(0.1073-0.0818)=0.0255$. The ratio of the final cross-sectional area to the area for the next to last reduction step was 0.0207/0.0255=0.806. The reduction is 19.4%. Before each reduction, each specimen was cleaned, visually examined, annealed pointed, and lubricated. The annealing temperature for all reduction steps except the ninth or last was above 1038° C., typically about 1051° C. The annealing temperature for the anneal preceding the last reduction was different for different specimens as tabulated in the first row, at A through J of the following Table VI:

TABLE VI

HIGH FLUENCE SWELLING DATA

| $\phi T$ ($10^{22}$ n/cm, E > 0.1MeV) | Irradiation Temperature (°C.) | A 1010* 1.52+ | B 1038 1.52 | C 1066 1.52 | D 1093 1.52 | E 1121 1.52 | I 1066 2.03 | J 1121 2.03 |
|---|---|---|---|---|---|---|---|---|
| 10.3 | 370 | 0.11 | 0.063 | 0.23 | 0.31 | 0.32 | 0.18 | 0.54 |
| 12.3 | 400 | 1.52 | 1.38 | 1.70 | 1.71 | 1.85 | 1.41 | 1.82 |
| 14.3 | 433 | 5.21 | 4.47 | 4.52 | 4.62 | 4.75 | 4.35 | 4.53 |
| 12.3 | 467 | 7.79 | 7.64 | 8.60 | 8.27 | 7.84 | 8.11 | 8.19 |
| 16.0 | 500 | 22.0 | 23.8 | 24.8 | 24.8 | 26.1 | 24.8 | 25.2 |
| 14.6 | 533 | — | — | 19.2 | 19.8 | — | — | 19.3 |
| 16.8 | 567 | 22.0 | 25.6 | 28.0 | 29.9 | 30.7 | 27.4 | 29.5 |
| 15.8 | 600 | 16.4 | 19.3 | 21.5 | 23.3 | 22.6 | 19.9 | 21.8 |
| 16.6 | 650 | 15.1 | 17.1 | 19.8 | 20.5 | 19.8 | 18.1 | 20.1 |

* = Temper point annealing temperature (°C.)
+ = Furnace feed rate (cm/sec.)

DETAILED DESCRIPTION OF INVENTION

The investigation which culminated in this invention was carried out with 316 stainless steel articles having the compositions shown in Table IV and the ranges shown in Table V. This alloy CK-25 was made available for the investigation responsive to a request for an alloy having the composition in the left-hand column of Table I. The investigation was carried out with speci- After being reduced, each specimen was irradiated with neutrons for a predetermined interval, then the swelling was evaluated by converting pre- and post-irradiation measurement of density of each specimen to volume-change measurements. The results of the measurements are shown in Table VI. The fluence, $\phi T$, flux multiplied by time, is presented in the left-hand column.

The temperature at which the irradiation took place appears in the second column from the left. The other columns A through J present the percent change in volume for the different annealing temperature before the last reduction. The head of each column A through J includes the annealing temperature and the rate in centimeter per second at which the specimens were moved through the heating zone. A rate of 1.50 cm/sec corresponds to 90 seconds in the annealing temperature zone and a rate of 2.00 cm/sec corresponds to 60 seconds in the annealing temperature zone. Assuming the relationship of rate of movement and time in the annealing-temperature zone to be linear, the relationship between time T and rate of movement r is given by the equation:

$$T = -60r + 180$$

Based on this equation, 1.52 cm/sec corresponds to 88.8 seconds in the annealing temperature zone; 2.03 cm/sec corresponds to 58.2 seconds in the annealing-temperature zone.

Table VI shows that there is a general tendency or trend for swelling to increase as the annealing temperature increases. The increase in swelling with annealing temperature is more pronounced at higher swelling. However, there are marked exceptions to the general tendency. At low irradiation temperatures, between 370° C. and 467° C., the swelling for 1038° C. is lower than for 1010° C. The specimen is maintained in the annealing temperature zone for 88.8 seconds for both temperatures. The relationship between columns C and I may be anticipated. For both columns the annealing temperature was 1066° C. but for column C, the specimen was maintained in the annealing-temperature zone for 88.8 seconds and for column I for 58.2 seconds. Except for irradiation at 500° C., the swelling is lower for the smaller time in the annealing-temperature zone. As is revealed by comparing columns E and J, the relationship of the swelling to the time in the annealing-temperature zone for 1121° C. is not as well defined as it is at 1066° C.

Figure 2:
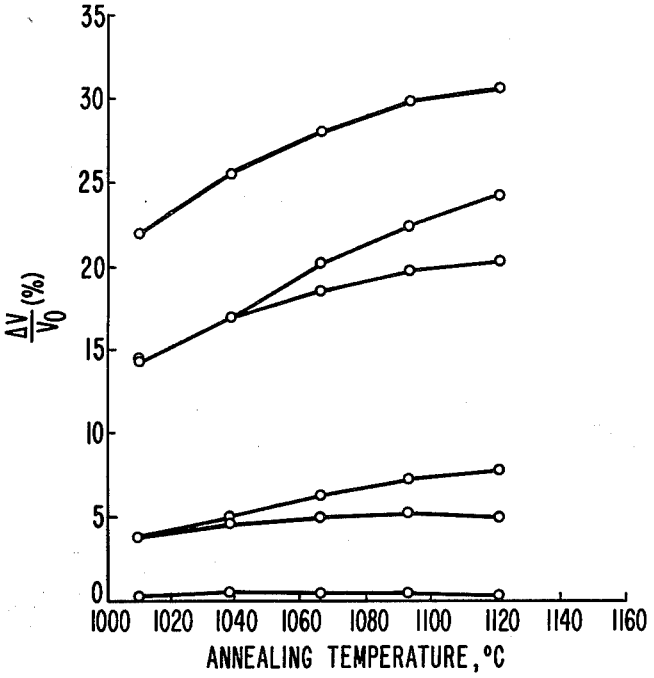
FIG. 2 is a graph showing how the swelling of an article of 316 stainless steel varies as a function of the annealing temperature.

In FIG. 2 swelling in percent of change of volume, $\Delta V/V_o$, is plotted as a function of annealing temperature, $\Delta V$ being the change in volume and $V_o$ being the volume before irradiation. The upper curve is at a fluence of $16.8\times10^{22}$ n/cm$^2$; the other curves, in descending order, are at 14.2, 14.4, 9.3, 9.4, $5.2\times10^{22}$ n/cm$^2$. The data for FIG. 2 was derived at an irradiation temperature of 567° C. The parameter for the several curves is the fluence of epithermal neutrons as indicated. The swelling at each annealing temperature increases as the fluence increases. The swelling also increases as the annealing temperature increases.

Figure 3:
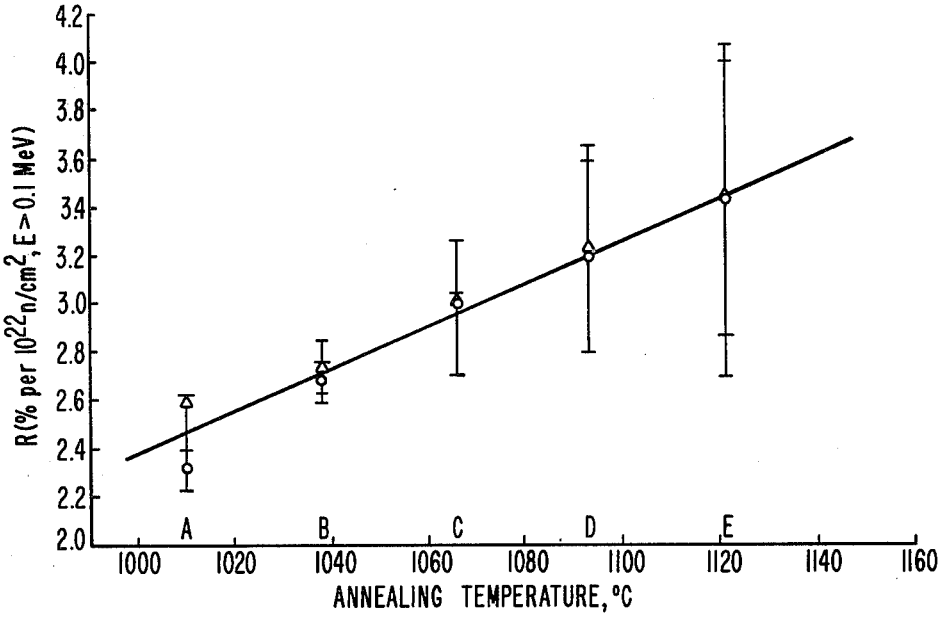
FIG. 3 is a graph showing the rate of swelling with respect to fluence of an article as a function of the annealing temperature.

In FIG. 3 the present swelling rate R with respect to fluence is plotted as a function of annealing temperature. R = % swelling per $10^{22}$ neutrons per square centimeter. R is the quotient of the swelling by the neutron fluence. The unit of fluence is $10^{22}$ n/cm$^2$ and R is the product of the flux $\phi$ by the time of irradiation T. If the flux is $10^{15}$ n/cm$^2$, the unit fluence of $10^{22}$ n/cm$^2$ corresponds to irradiation for $10^7$ seconds. The points which determine the curve correspond to the fluences determined for annealing temperature A through E of Table VI at irradiation temperatures at 500° C. and 567° C. These points are labelled A through E along the annealing-temperature axis. The vertical lines through the points are measures of the error bands at these points. FIG. 2 shows that the swelling increases with increasing annealing temperature, while FIG. 3 shows that the rate of swelling also increases.

Figure 4:
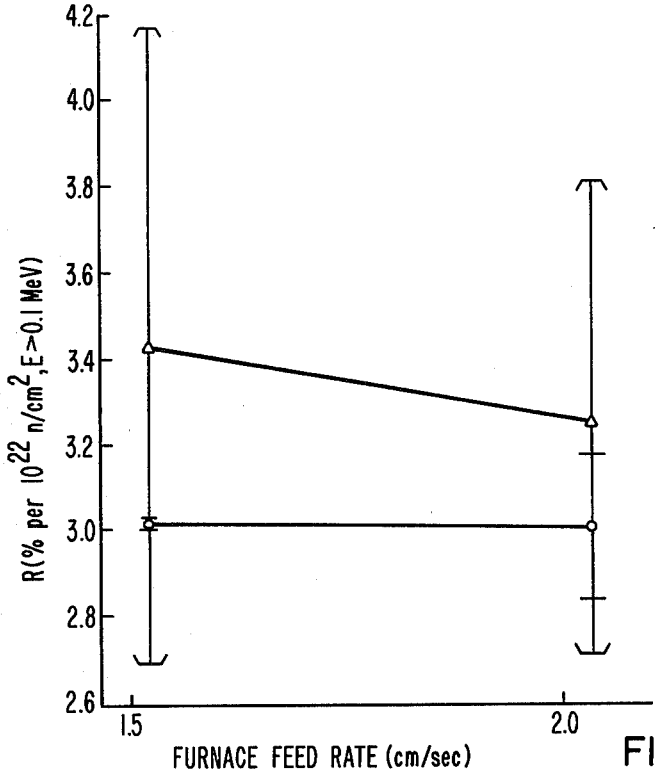
FIG. 4 is a graph showing rate of swelling with respect to fluence of an article irradiated at 500° C. as a function of the duration of the heating at the annealing temperature.

FIG. 4 shows the rate of swelling with respect to fluence as a function of the time in the annealing-temperature zone. The curves are for annealing temperatures of 1066° C. and 1121° C. The article was irradiated at 500° C. The time in the zone is given in cm/sec. The points which determined the plots were determined for movement of 1.52 cm/sec or 88.8 seconds and 2.03 cm/sec or 58.2 seconds. For the higher annealing temperature, 1121° C., the rate decreases as the duration in the annealing-temperature zone decreases. For the lower temperature, 1066° C., there is no change. The vertical lines through the points determining the curves show the extent of the error band.

Figure 5:
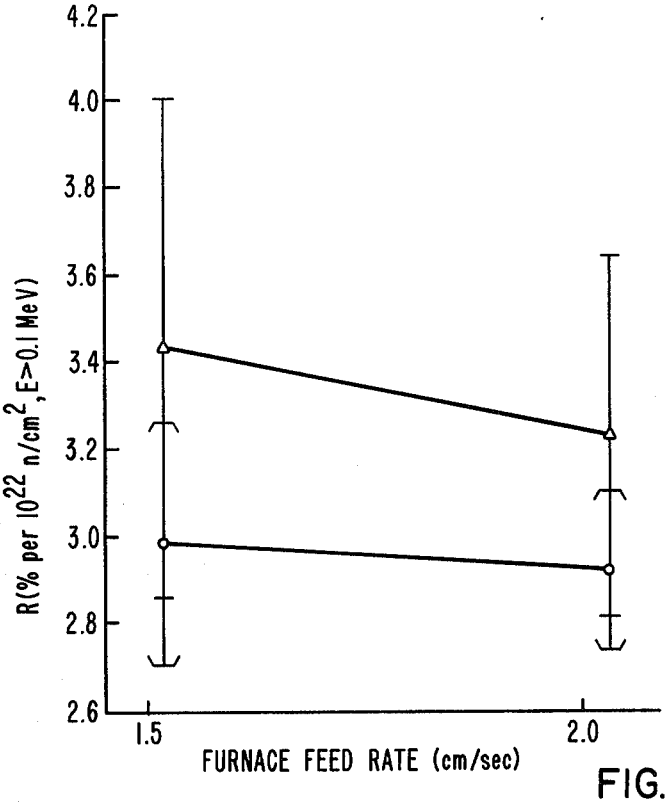
FIG. 5 is a similar graph for an article irradiation at 567° C.

FIG. 5 is a graph similar to FIG. 4 but for articles irradiated at 567° C. FIG. 5 shows a larger decrease in rate than FIG. 4 for annealing temperature 1121° C. and a small decrease for annealing temperature 1066° C.

Figure 6:
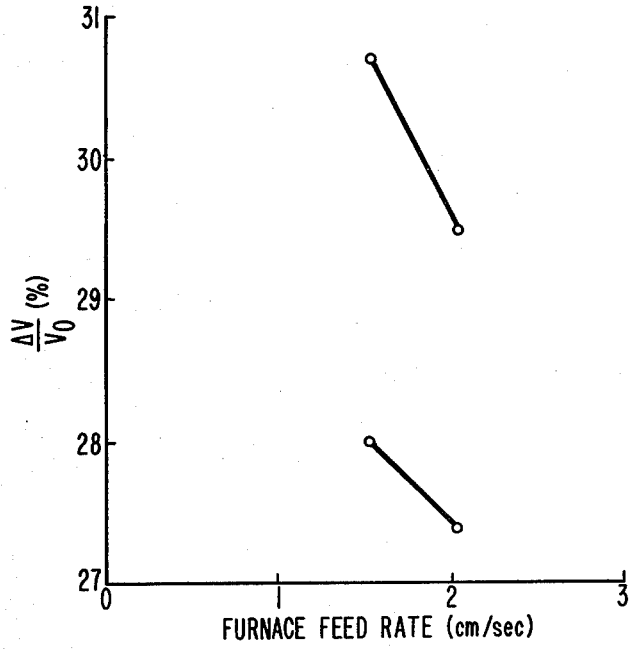
FIG. 6 is a graph showing the swelling as a function of the duration of the heating at the annealing temperature.

FIG. 6 shows the swelling as a function of the time the articles are in the annealing temperature zone for annealing temperatures of 1066° C. and 1121° C. The data for the graph was derived at irradiation of 567° C. Time is plotted as furnace feed rate. The points for each curve are at 1.52 cm/sec or 88.8 seconds and at 2.03 cm/sec or 58.2 seconds. The graph shows that the swelling decreases as the time in the annealing-temperature zone decreases. The decrease is greater at 1121° C. than at 1066° C. It is emphasized that the percent swelling scale for FIG. 6 is about seven times the length of the scale for FIG. 2 so that the extent of variation of the swelling shown in FIG. 6 should be divided by 7 for comparison with the variation of swelling in FIG. 2.

Figure 7:
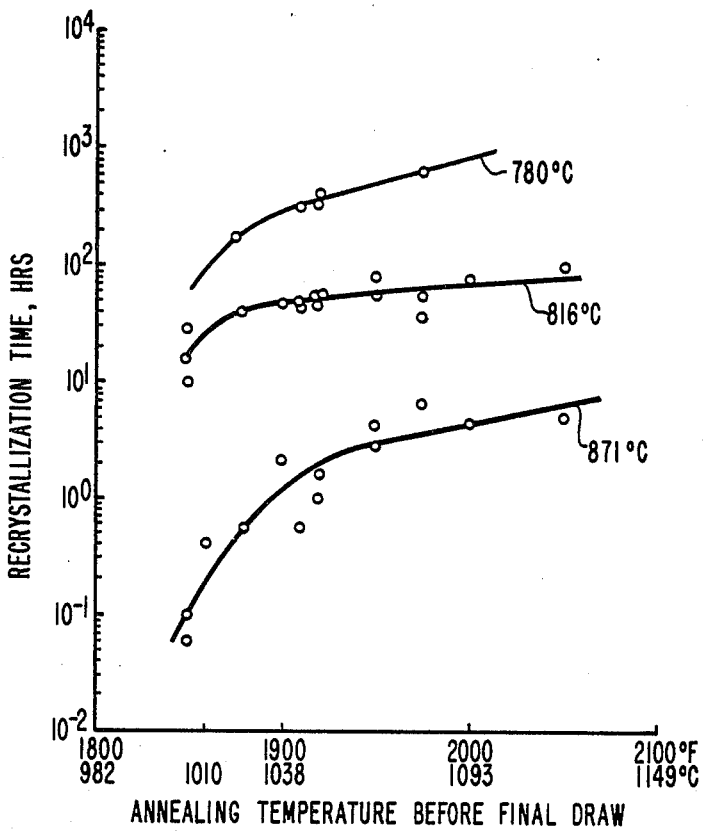
FIG. 7 is a graph showing the recrystallization time as a function of the annealing temperature.
Figure 8:
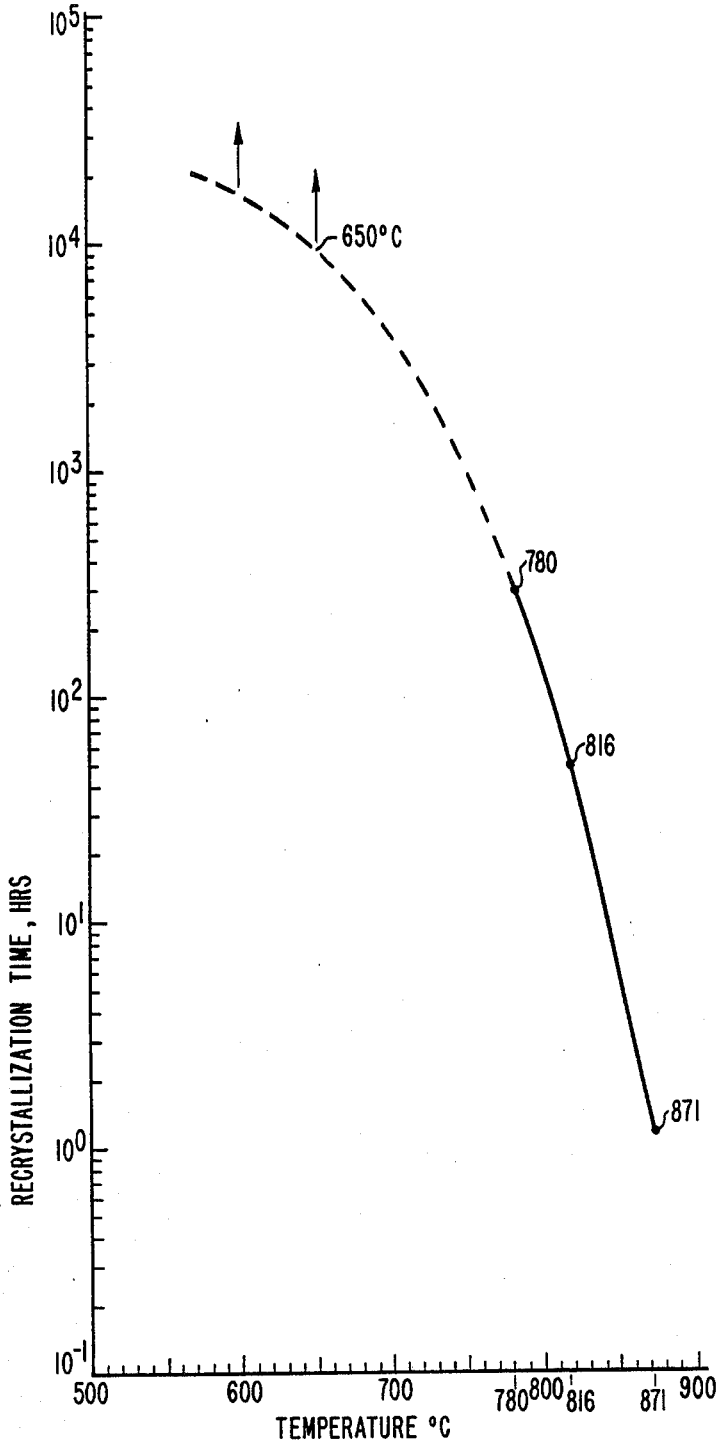
FIGS. 8 and 9 are graphs showing the recrystallization time as a function of the temperature of the processed article at annealing temperatures of 1038° C. and 1010° C., respectively.

In FIG. 7 the recrystallization time is plotted as a function of the annealing temperature for the article maintained (or aged) at temperatures 871° C., 816° C., 780° C. Specimens from heat 81615, as well as specimens from the CN-13 heat, and other heats of 316 alloy steel were heated to the indicated temperatures for different time intervals in an inert atmosphere and the recrystallization time was determined. The recrystallization time decreases sharply as the temperature at which the article was heated increases. At temperatures between 593° C. and 649° C. at which the 316 stainless steel is normally used, the recrystallization time, for articles annealed between 1010° C. and 1038° C., is of the order of 5000 hours or higher. This is clearly shown in FIGS. 8 and 9. FIG. 8 is a graph based on FIG. 7 showing the recrystallization time as a function of temperature for an annealing temperature of 1038° C. Data from material, annealed at 1043° and 1038° C. and then aged at 780°, 816° and 871° C. were used to plot the FIG. 8 recrystallization curve. The curve below 780° C. is a conservative extrapolation of this FIG. 7 data. The extrapolated portion of this curve is also supported by data from heat CN-13, annealed at 1043° C. and material from other heats annealed at temperatures above 1043° C., which when aged for 10,000 hours at 650° C. showed no significant signs of recovery, let alone recrystallization.

Figure 9:
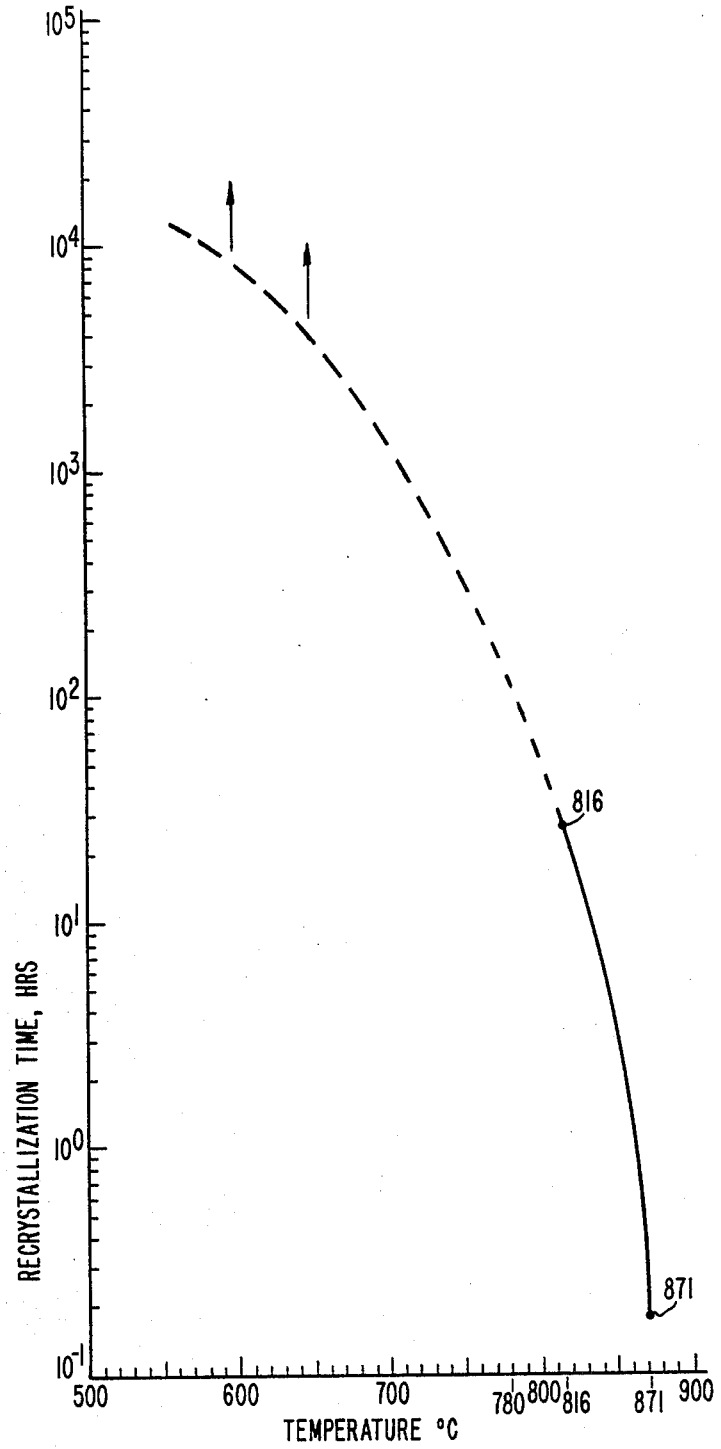

This data from the 650° C., 10,000 hour of material annealed at 1043° C. or higher is believed to be applicable to the prediction of the 593° and 649° C. recrystallization behavior of materials annealed at 1010° and 1038° C., since it has been found that at these lower aging temperatures, recrystallization time is not as strong a function of annealing temperature as it is at the higher aging temperatures (e.g. 780°, 816°, and 871° C.). Therefore, based on this data, and the data obtained from FIG. 7 it is firmly believed that material annealed between about 1038° or 1010° C. (FIG. 9) will not recrystallize in use at 593° or 649° C., for periods up to about 10,000 hours, and most assuredly for periods on the order of 5000 hours. FIG. 9 is similar to FIG. 8, but is for an annealing temperature of 1010° C. The curve shown is based upon FIG. 7 data at aging treatments at 816° and 871° C. which was then conservatively extrapolated to the lower aging temperatures.

It has been speculated that the increase in swelling as the annealing temperature increases may result from reduced incubation. Incubation is the absence of swelling for a time interval following the initiation of irradiation. The higher the annealing temperature, the shorter the interval for incubation.

Analysis of the data developed during the above-described investigation as summarized in FIGS. 2 through 9 confirms that swelling of the articles of 316 stainless steel under neutron irradiation is reduced if during the reduction process, the annealing temperature for at least one reduction step is maintained below 1038° C. for the appropriate interval to produce the annealing. Specifically, the annealing temperature is maintained between 1010° C. and 1038° C. for an interval between 90 seconds and 60 seconds before the last reduction step.

While specific practice of this invention is disclosed herein, many modifications thereof are feasible. This invention is not to be restricted, except insofar as is necessitated by the spirit of the prior art.

We claim:

1. The method of treating an article composed of the alloy having the following composition in weight percent:

| | |
|---|---|
| Chromium | 17.00–18.00 |
| Nickel | 13.00–14.00 |
| Carbon | 0.040–0.060 |
| Molybdenum | 2.00–3.00 |
| Manganese | 1.50–2.00 |
| Nitrogen | 0.010 maximum |
| Aluminum | 0.050 maximum |
| Arsenic | 0.030 maximum |
| Boron | 0.0010 maximum |
| Cobalt | 0.050 maximum |
| Columbium | 0.050 maximum |
| Copper | 0.04 maximum |
| Phosphorous | 0.020 maximum |
| Silicon | 0.50–0.75 |
| Sulphur | 0.010 maximum |
| Tantalum | 0.020 maximum |
| Vanadium | 0.200 maximum |
| Iron | Balance |

so as to reduce swelling under neutron bombardment, the said method comprising cold working said article in repeated steps, reducing the size of said article during each step so that it has predetermined final dimensions, said article being annealed, prior to each size-reduction step, by being heated to an annealing temperature within a predetermined temperature range and for a predetermined interval of time, and after said interval cooling said article, the said annealing temperature range for at least one of said annealing and reduction processes being such that swelling of an article treated by the method, under irradiation by neutron flux, is minimized while the time interval of continuous heating of the article at an elevated temperature, following treatment of the article by this method, after which recrystallization occurs, is at least of the order of 5000 hours.

2. The method of treating an article composed of the alloy having the following composition in weight percent:

| | |
|---|---|
| Chromium | 17.00–18.00 |
| Nickel | 13.00–14.00 |
| Carbon | 0.040–0.060 |
| Molybdenum | 2.00–3.00 |
| Manganese | 1.50–2.00 |
| Nitrogen | 0.010 maximum |
| Aluminum | 0.050 maximum |
| Arsenic | 0.030 maximum |
| Boron | 0.0010 maximum |
| Cobalt | 0.050 maximum |
| Columbium | 0.050 maximum |
| Copper | 0.04 maximum |
| Phosphorous | 0.020 maximum |
| Silicon | 0.50–0.75 |
| Sulphur | 0.010 maximum |
| Tantalum | 0.020 maximum |
| Vanadium | 0.200 maximum |
| Iron | Balance |

so as to reduce swelling under neutron bombardment, the said method comprising cold working said article in repeated steps, reducing the size of the article at each step, so that it has predetermined final dimensions, and prior to the last step, annealing said article by heating said article within an annealing temperature range and for a predetermined time interval such that swelling, of an article heated by this method, under irradiation by neutron flux is minimized while the time interval of continuous heating of the article at an elevated temperature following treatment by this method after which recrystallization occurs is at least of the order of 5000 hours, and after said interval cooling said article.

3. The method of claim 2 wherein the alloy has the following composition in weight percent:

| | |
|---|---|
| Chromium | 17.46–17.56 |
| Nickel | 13.67–13.82 |
| Carbon | 0.056–0.057 |
| Molybdenum | 2.28–2.34 |
| Manganese | 1.66–1.70 |
| Nitrogen | 0.003–0.004 |
| Aluminum | 0.005–0.011 |
| Arsenic | <0.005 |
| Boron | 0.0005–0.0007 |
| Cobalt | 0.01 |
| Columbium | <0.005 |
| Copper | <0.01 |
| Phosphorous | 0.002 |
| Silicon | 0.50–0.51 |
| Sulphur | 0.003 |
| Tantalum | <0.01 |
| Vanadium | <0.01 |
| Iron | Balance |

4. The method of claim 1 wherein the article is annealed at an annealing temperature of t°C., not less than 1010° C. and not more than 1038° C., the said article being maintained at t°C. for a time interval in seconds of 90-ΔT where ΔT is given by the equation:

$$\Delta T = \frac{30(t - 1010)}{28}.$$

5. The method of claim 5 wherein the minimum heating rate to the annealing temperature of t°C. is 540 C.° per minute and the minimum cooling rate from the temperature of t°C. is 870 C.° per minute.

6. The method of claim 1 wherein the elevated temperature is a temperature between 593° C. and 649° C.

7. The method of claim 2 wherein the elevated temperature is a temperature between 593° C. and 649° C.

* * * * *

UNITED STATES PATENT AND TRADEMARK OFFICE

CERTIFICATE OF CORRECTION

PATENT NO. : 4,421,572

DATED : December 20, 1983

INVENTOR(S) : John F. Bates et al.

It is certified that error appears in the above—identified patent and that said Letters Patent is hereby corrected as shown below:

Column 1, beneath the title of the invention "Thermomechanical Treatment of Alloys" and above the heading "Background of the Invention" insert -- The present invention was made or conceived during the performance of work under Contract No. EY-76-C-14-2170 with the U.S. Department of Energy. --

Column 7, line 58, delete "R".

Signed and Sealed this

*Fourth* Day of *March 1986*

[SEAL]

*Attest:*

DONALD J. QUIGG

*Attesting Officer*

*Commissioner of Patents and Trademarks*